US009487024B2

(12) United States Patent
Kondo et al.

(10) Patent No.: US 9,487,024 B2
(45) Date of Patent: Nov. 8, 2016

(54) PRINTER

(71) Applicant: Brother Kogyo Kabushiki Kaisha, Nagoya-shi, Aichi-ken (JP)

(72) Inventors: Koichi Kondo, Inuyama (JP); Kazuya Nakagawa, Nagoya (JP); Shinya Goto, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/055,846

(22) Filed: Feb. 29, 2016

(65) Prior Publication Data

US 2016/0271975 A1 Sep. 22, 2016

(30) Foreign Application Priority Data

Mar. 20, 2015 (JP) ..... 2015-058525

(51) Int. Cl.

| | |
|---|---|
| ***B41J 29/393*** | (2006.01) |
| ***B41J 3/407*** | (2006.01) |
| ***B41J 11/70*** | (2006.01) |
| ***B41J 11/66*** | (2006.01) |

(52) U.S. Cl.

CPC ..... *B41J 3/4075* (2013.01); *B41J 11/663* (2013.01); *B41J 11/703* (2013.01)

(58) Field of Classification Search

CPC ..... B41J 3/4075; B41J 11/663; B41J 11/703

See application file for complete search history.

(56) References Cited

FOREIGN PATENT DOCUMENTS

JP H07-285240 A 10/1995

*Primary Examiner* — Julian Huffman

(74) *Attorney, Agent, or Firm* — Banner & Witcoff, Ltd.

(57) ABSTRACT

The disclosure discloses a printer including a controller to control a feeder and a printing head. A regular print mode includes a first cut-feeding process. In the first cut-feeding process, a print-receiving tape is further fed such that the print-receiving tape is positioned by stopping a feeding when a boundary position faces a cutter. A continuous print mode includes a continuous print feeding process. In the continuous print feeding process, the print-receiving tape is further fed such that the print-receiving tape is stopped with the boundary position facing the printing head. The controller is configured to execute a determination process and a second cut-feeding process. In the determination process, it is determined whether a predetermined environmental change condition is satisfied. In the second cut-feeding process, the print-receiving tape stopped is resumed such that the print-receiving tape is positioned by stopping when the boundary position faces the cutter.

7 Claims, 11 Drawing Sheets

PRINTER

CROSS-REFERENCE TO RELATED APPLICATION

The present application claims priority from Japanese Patent Application No. 2015-58525, which was filed on Mar. 20, 2015, the disclosure of which is incorporated herein by reference in its entirety.

BACKGROUND

1. Field

The present disclosure relates to a printer performing desired printing on a print-receiving tape.

2. Description of the Related Art

A printer is known that performs desired printing on a print-receiving tape. This printer (electronic tape writer) of prior art can continuously produce print tapes each having a desired print formed thereon in a connected state. In particular, when an appropriate print start instruction is input, after a desired print is formed by a thermal head on a predetermined portion of a fed print-receiving tape, the print-receiving tape is further fed and the feeding is stopped when a transport-direction upstream end part (boundary position) of the predetermined portion faces the thermal head. The tape is basically not cut by a cutter in this state and, when the next print start instruction is input, the same process is executed again from the state with the boundary position facing the thermal head (subsequently, the same process is repeated). As a result, a plurality of the print tapes is produced in a continuously connected form.

In the prior art, the cutter is positioned downstream of the thermal head along a feeding path. Therefore, when the process is completed in accordance with one print start instruction as described above, the boundary position faces the thermal head upstream of the cutter. As a result, when an operator attempts to acquire all the multiple print tapes continuously connected as described above, a manual operation (so-called tape feeding operation) is separately required for further feeding the print-receiving tape such that the boundary position located at the upstream end part of the print tape last in order (i.e., positioned most upstream of all the tapes) is at a position facing the cutter, resulting in a large operational labor burden. If the operator forgets to perform this operation before cutting with the cutter, the print tape last in order may be divided halfway.

SUMMARY

It is an object of the present disclosure to provide a configuration capable of reducing an operator's operational labor burden and preventing a print tape from being divided halfway in a printer having a function of continuously producing a plurality of print tapes without cutting.

In order to achieve the above-described object, according to the aspect of the present application, there is provided a printer comprising a feeder configured to feed a print-receiving tape, a printing head that is configured to perform print on the print-receiving tape and is disposed on a feeding path of the feeder, a cutter that is configured to cut the print-receiving tape in a thickness direction and is disposed downstream of the printing head along the feeding path, and a controller, the controller being configured to control the feeder and the printing head in coordination with each other to selectively perform either a regular print mode or a continuous print mode, the regular print mode including performing a print formation process for forming a desired print while feeding the print-receiving tape and a first cut-feeding process for further feeding the print-receiving tape after completion of the print formation process such that the print-receiving tape is positioned by stopping the feeding when a boundary position of said print-receiving tape faces said cutter wherein the boundary position is defined as a boundary between a printed tape portion having the desired print formed thereon and an unprinted tape portion, the continuous print mode including performing the print formation process and a continuous print feeding process for further feeding the print-receiving tape after completion of the print formation process such that the feeding of the print-receiving tape is stopped with the boundary position of the print-receiving tape facing the printing head, the controller being configured to execute a determination process for determining whether a predetermined environmental change condition is satisfied while the continuous print mode is selected, and control the feeder to execute a second cut-feeding process, in the case that it is determined in the determination process that the environmental change condition is satisfied, for resuming the feeding of the print-receiving tape stopped with the boundary position located facing the printing head by the continuous print feeding process such that the print-receiving tape is positioned by stopping the feeding when the boundary position faces the cutter.

The printer of the present disclosure has a printing head and a cutter disposed downstream of the printing head in the feeding direction. The regular print mode and the continuous print mode are selectively performed in accordance with the control of the controller.

In the regular print mode, for example, when an appropriate print start instruction is input, after a desired print is formed on a fed print-receiving tape (the print formation process) to form a printed tape portion, the print-receiving tape is further fed and is positioned by stopping the feeding when a transport-direction upstream end part (the boundary position) of the above described printed tape portion faces the cutter (the first cut-feeding process), entering a standby state of waiting for the cutter to cut the above described boundary position. Subsequently, when the cutter operates in accordance with an operator's manual operation (or in accordance with the appropriate control of the controller), the above described cutting is performed to separate the printed tape portion having the above described desired print formed thereon from an unprinted tape portion upstream of the boundary position and a print tape is produced.

On the other hand, in the continuous print mode, when an appropriate print start instruction is input, after a desired print is formed on a fed print-receiving tape (the print formation process) to form a printed tape portion in the same way as the above description, the print-receiving tape is further fed and the feeding is stopped when the transport-direction upstream end part (the boundary position) of the above described printed tape portion faces the printing head rather than the above described cutter (the continuous print feeding process). The tape is basically not cut by the cutter in this state and, when the next print start instruction is input, the print formation process and the continuous print feeding process as described above are executed again from a feeding stop state with the above described boundary position facing the printing head (subsequently, the same processes are repeated). As a result, a plurality of the above described print tapes is produced in a continuously connected form (so-called chain print).

As described above, the cutter is positioned downstream of the printing head along a feeding path. Therefore, when the above described print formation process and the continuous print feeding process are completed in accordance with one print start instruction in the continuous print mode, the boundary position faces the printing head upstream of the cutter. As a result, when an operator attempts to acquire all the multiple print tapes continuously connected as described above, a manual operation (so-called tape feeding operation) is separately required for further feeding the print-receiving tape such that the above described boundary position located at the upstream end part of the print tape last in order (i.e., positioned most upstream of all the tapes) is at a position facing the cutter. If the operator forgets to perform this operation before cutting with the cutter, the print tape last in order is divided halfway.

Therefore, in the preset disclosure, the controller executes a determination process. In this determination process, it is determined whether a predetermined environmental change condition is satisfied while the above described continuous print mode is selected. Specifically, the above described environmental change condition is satisfied when the printer is powered off or when predetermined settings (e.g., various settings at the time of print formation such as margin setting) are changed in the printer. If the printer is connected and used with an operation terminal, the above described environmental change condition is satisfied when mutual recognition communication with the operation terminal is interrupted. By way of example, this corresponds to when the operation terminal goes out of a wireless communication area, when the operation terminal is powered off, and when a cable connected to the operation terminal is pulled out of the printer (or the operation terminal).

If the above described condition is satisfied and the determination in the determination process becomes affirmative, the controller controls the feeder to resume the feeding of the print-receiving tape (from the state with the above described printing head facing the boundary position), and the print-receiving tape is positioned by stopping the feeding when the above described boundary position faces the cutter (second cut-feeding process), entering the standby state of waiting for the cutter to cut the above described boundary position.

As a result, when the cutter operates in accordance with an operator's manual operation (or in accordance with the appropriate control of the controller) at subsequent timing to perform the cutting, the printed tape portion having the above described desired print formed thereon can be separated from an unprinted tape portion upstream of the boundary position so as to produce a print tape. As a result, since the above described separate tape feeding operation by the operator is no longer required, the operator's labor burden can be reduced and the inconvenience such as dividing a print tape halfway as described above can be prevented.

DESCRIPTION OF THE PREFERRED EMBODIMENTS

An embodiment of the present disclosure will now be described with reference to the drawings.

<General Configuration>

Figure 1:
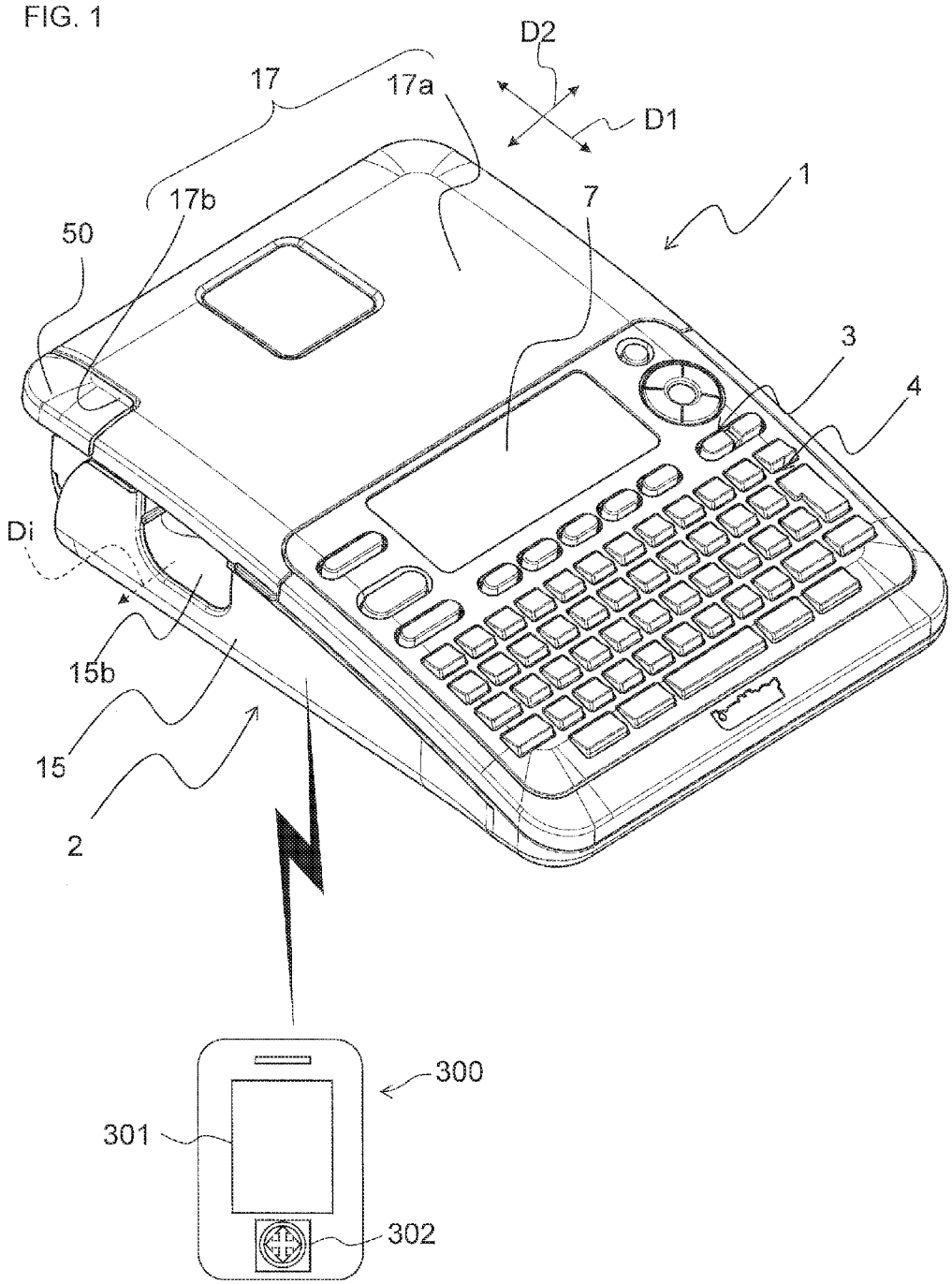
FIG. 1 is an exterior perspective view showing a tape printer to which an embodiment of the present disclosure is applied, along with an operation terminal.

FIG. 1 shows a tape printer of this embodiment along with an operation terminal capable of operating the tape printer. In FIG. 1, a tape printer 1 and an operation terminal 300 are connected through well-known mutual recognition wireless communication or mutual recognition wired communication (achieved by normal cable connection) such that information can be transmitted and received.

The operation terminal 300 is, for example, an information terminal such as a PDA (personal digital assistance) and a smartphone (portable telephone with a PDA function) having the above described communication function. This operation terminal 300 has, for example, a touch panel 301 and an operation button 302. The touch panel 301 has a display function of displaying various pieces of information and messages on a liquid crystal display etc. and allows an operator to input desired instructions and information in combination with the above described operation button 302. Therefore, subsequently, the above described display function portion of the touch panel will be simply referred to as a "display part 301", and the above described operation function portion and the above described operation button of the touch panel will collectively simply be referred to as an "operation part 302". The operation terminal 300 of this example can transmit/receive information to/from the tape printer 1 through the above described mutual recognition wireless communication and can cause the tape printer 1 to print desired print data (described later in detail).

<Configuration of Tape Printing Apparatus>

Figure 2:
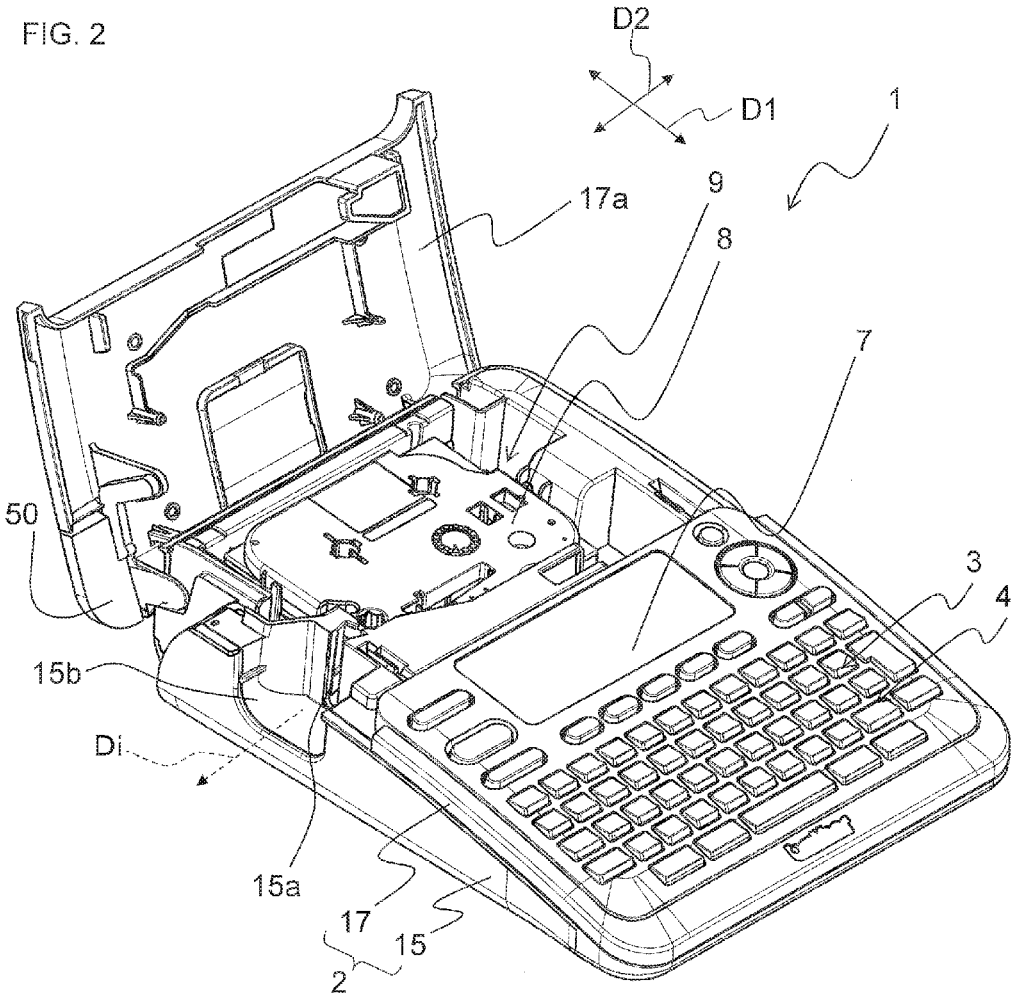
FIG. 2 is an exterior perspective view of the tape printer with a cartridge cover opened.

The above described tape printer 1 will be described. As shown in FIGS. 1 and 2, the tape printer 1 includes a housing 2 making up an outer contour thereof. The housing 2 includes a resin lower cover 15 making up an apparatus lower surface and integrated with apparatus side surfaces as well as a resin upper cover 17 making up an apparatus upper surface.

Figure 3:
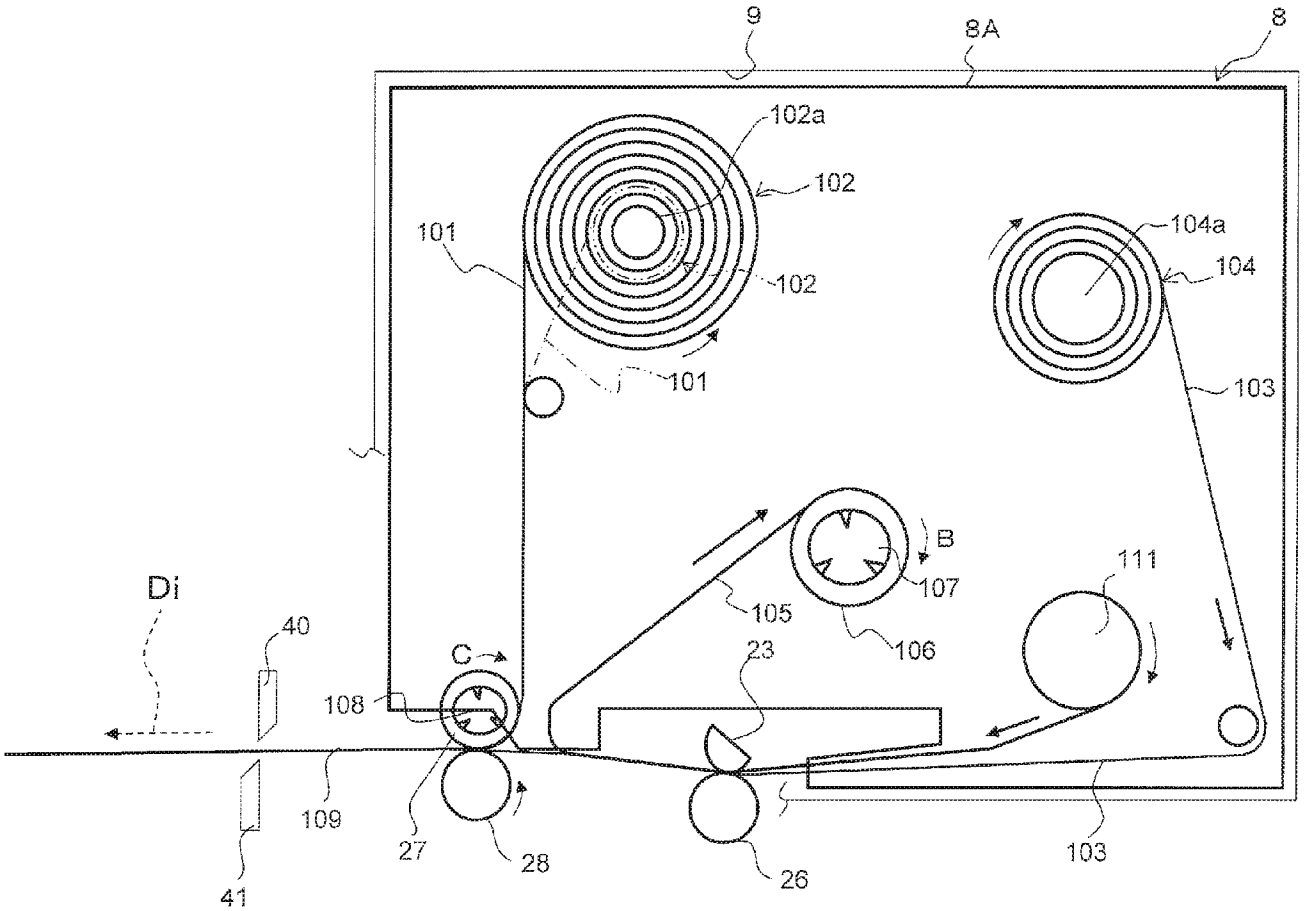
FIG. 3 is a conceptual plane view of an internal structure of a cartridge.

A side surface of the lower cover 15 includes a recessed part 15*b* and a discharging exit 15*a* formed at the center of an innermost part inside the recessed part to discharge a printed label tape 109 (see FIG. 3 described later).

The upper cover 17 is disposed with, from the front side toward the rear side, a keyboard 3 for performing various operations such as character input, functional keys 4 such as a power switch and a print key for causing the tape printer 1 to perform various functions, and a transparent panel 7 mounted to close an opening part like a rectangular opening, for example.

The upper cover 17 includes a lid-like cartridge cover 17*a* that can be opened for mounting a tape cassette-like cartridge 8 on the upper surface rear part side and that opens and closes a cartridge holder 9. This cartridge cover 17*a* has a cutout part 17*b* disposed to an end part in a direction Di (see FIG. 1) orthogonal to a direction Di (see FIG. 1) of a tape feeding path in the vicinity of the above described discharging exit 15*a* and in a direction D2 (see FIG. 1) orthogonal thereto. A cut lever 50 used as an operation lever for cutting the above described printed label tape 109 is disposed such that the cut lever 50 is received in the cutout part 17*b*.

The tape printer 1 has the cartridge holder 9 disposed on the upper surface rear part side thereof such that the cartridge 8 is detachably mounted. This cartridge holder 9 is always closed by the above described cartridge cover 17*a* (see FIG. 1) and, when the cartridge cover 17*a* is opened, the cartridge holder 9 is exposed (see FIG. 2).

Detailed structures of the cartridge 8 and the cartridge holder 9 will be described with reference to FIG. 3. The cartridge 8 has a housing 8A, a first roll 102 having a wound belt-shaped base tape 101 located in the housing 8A (actually having a spiral shape and simplified into a concentrically circular shape in FIG. 3), a second roll 104 having a wound transparent print-receiving tape 103 with substantially the same width as the above described base tape 101 (actually having a spiral shape and simplified into a concentrically circular shape in FIG. 3), a ribbon supply side roll 111 feeding out an ink ribbon 105 (not necessary if the print-receiving tape is a thermal tape), a ribbon take-up roller 106 taking up the ink ribbon 105 after print, and a transport roller 27 rotatably supported in the vicinity of a tape discharging part of the cartridge 8.

The first roll 102 has the above described base tape 101 wound around a reel member 102*a*. The base tape 101 includes, for example, a bonding adhesive layer, a base film, an affixing adhesive layer, and a separation sheet laminated in this order from the inner wound side toward the opposite side. The second roll 104 has the above described print-receiving tape 103 wound around a reel member 104*a*.

The transport roller 27 feeds the above described base tape 101 and the above described print-receiving tape 103 in the direction Di described above while pressing and bonding the tapes into the above described printed label tape 109.

On the downstream side of the transport roller 27 and a pressure roller 28 along the feeding path of the printed label tape 109 (i.e., on the downstream side of a printing head 23 described later), a fixed blade 40 is disposed along with a movable blade 41 advancing toward the above described fixed blade 40 in accordance with an manual operation of the above described cut lever 50 to cut the printed label tape 109 in a thickness direction in cooperation with fixed blade 40.

On the other hand, the cartridge holder 9 is disposed with a ribbon take-up roller driving shaft 107 for taking up the above described ink ribbon 105 used in the cartridge 8, and a feeding roller driving shaft 108 for feeding the above described printed label tape 109. The ribbon take-up roller 106 and the transport roller 27 described above are rotationally driven in conjunction with each other by transmitting a drive force of a feeding motor not shown to the above described ribbon take-up roller driving shaft 107 and the above described feeding roller driving shaft 108. The printing head 23 performing desired printing on the fed print-receiving tape 103 is disposed on the cartridge holder 9 such that the printing head 23 is positioned at an opening part of the cartridge 8 when the cartridge 8 is mounted. The printing head 23 is located away from the above described movable blade 41 and the fixed blade 40 at a predetermined separation distance La along the tape feeding path (see FIG. 5 etc. described later).

<General Operation of Producing Print Tape>

When the cartridge 8 is mounted on the above described cartridge holder 9 in the above described configuration, the print-receiving tape 103 and the ink ribbon 105 are interposed between the printing head 23 and a platen roller 26 facing thereto. The base tape 101 and the print-receiving tape 103 are interposed between the transport roller 27 and the pressure roller 28 facing thereto. The ribbon take-up roller 106 and the transport roller 27 are then rotationally driven in a synchronized manner in respective direction indicated by arrows B and C in FIG. 3. As a result, the transport roller 27, the pressure roller 28, and the platen roller 26 are rotated, and the base tape 101 is fed out from the first roll 102 and supplied to the transport roller 27. On the other hand, the print-receiving tape 103 is fed out from the second roll 104 and a print-head driving circuit 31 (see FIG. 4 described later) energizes a plurality of heat generation elements of the printing head 23. As a result, a print is printed on a back surface of the print-receiving tape 103.

The above described base tape 101 and the print-receiving tape 103 after completion of the above described printing are bonded and integrated by the above described transport roller 27 and the pressure roller 28 into the printed label tape 109, which is fed outside the cartridge 8 from the tape discharging part. The ink ribbon 105 after printing to the print-receiving tape 103 is taken up by the ribbon take-up roller 106 by driving the ribbon take-up roller driving shaft 107.

The printed label tape 109 fed outside the cartridge 8 as described above is cut by the movable blade 41 and the fixed blade 40 cooperating with each other base on an manual operation of the above described cut lever 50, and a print label L (see FIG. 5 described later) is produced. Since the printed label tape 109 includes the print-receiving tape 103 after printing, the fixed blade 40 and the movable blade 41 fulfill a function of cutting the print-receiving tape 103 after printing. As described above, the cutting in this case is achieved by transmitting the manual operation of the above described cut lever 50 by an operator via a mechanism not shown to the movable blade 41 and causing the movable blade 41 to advance toward the fixed blade 40 so that the movable blade 41 and the fixed blade 40 are closed like scissors.

<Functional Configurations of Tape Printing Apparatus and Operation Terminal>

Functional configurations of the tape printer 1 and the operation terminal 300 will be described with reference to FIG. 4.

Figure 4:
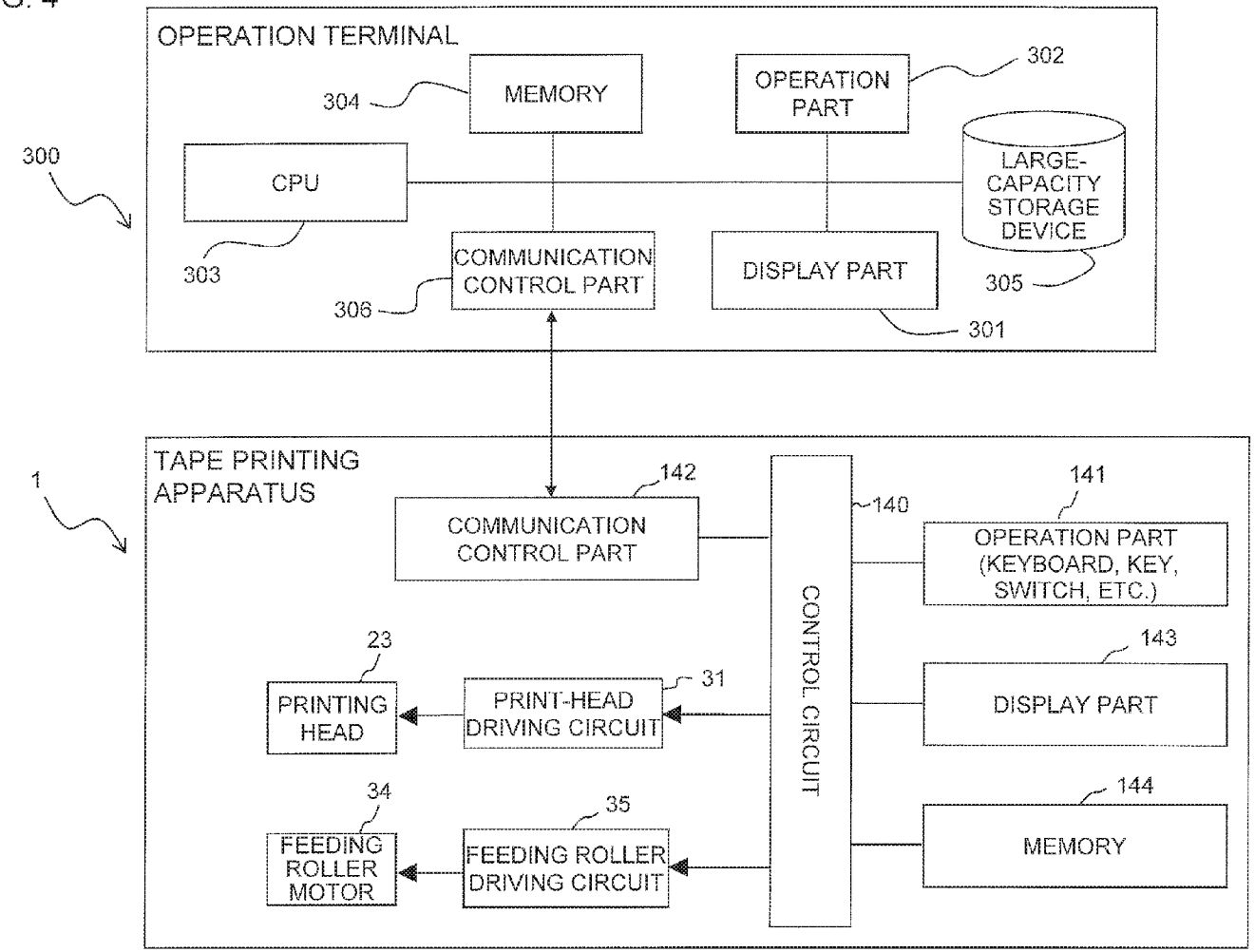
FIG. 4 is a functional block diagram of the tape printer and the operation terminal.

In FIG. 4, the tape printer 1 includes the above described printing head 23 performing desired printing on the print-receiving tape 103; the print-head driving circuit 31 controlling and causing the printing head 23 to perform a print operation of desired print contents for the print-receiving tape 103; a feeding roller motor 34 driving the above described platen roller 26; a feeding roller driving circuit 35 controlling the feeding roller motor 34; a control circuit 140 controlling the overall operation of the tape printer 1 via the print-head driving circuit 31, the feeding roller driving circuit 35, etc.; an operation part 141 such as the above described keyboard 3 and the above described functional keys 4; a display part 143; a memory 144 consisting of a RAM and a ROM, for example; and a communication control part 142 performing the above described mutual recognition communication including connection authentication through a known technique with the above described operation terminal 300. The above described ROM of the memory 144 stores a printing process program for executing a printing process method including procedures of flows of FIGS. 10 and 11 described later.

The operation terminal 300 includes a CPU 303, a memory 304 consisting of, for example, a RAM and a ROM, the above described operation part 302, the above described display part 301, a large-capacity storage device 305 consisting of a hard disk device etc. and storing various pieces of information, and a communication control part 306 transmitting/receiving information to/from the above described tape printer 1 through the above described mutual recognition communication.

The CPU 303 executes a signal process in accordance with a program stored in the ROM in advance while using a temporary storage function of the RAM, thereby transmitting/receiving various instruction signals and information signals to/from the tape printer 1.

<Regular Print Mode and Continuous Print Mode>

The tape printer 1 having the above described configuration includes two modes, i.e., a regular print mode in which the print label L produced from the printed label tape 109 as described above is cut and separated from an unprinted tape portion positioned upstream thereof along a tape feeding direction, and a continuous print mode in which a portion corresponding to the print label L (hereinafter also simply referred to as a "print label part Lo") is kept connected to the above described unprinted tape portion positioned upstream thereof without separating as described above. Basic operations in these two modes will be described.

<Print Label Producing Operation in Regular Print Mode>

First, a producing operation of a print tape in the above described regular print mode will be described with reference to FIGS. 5A to 5F. Actually, the above described base tape 101 is bonded by the transport roller 27 and the pressure roller 28 to the print-receiving tape 103 on which a print is formed by the printing head 23 as described above to form (on the downstream side thereof) the printed label tape 109; however, to avoid complexity in FIGS. 5A to 5F, the tapes are shown in a simplified manner as one tape to which reference numeral "103(109)" is added (the same applies to FIGS. 6A to 9C described later).

Figures 5A, 5B, 5C, 5D, 5E, 5F:
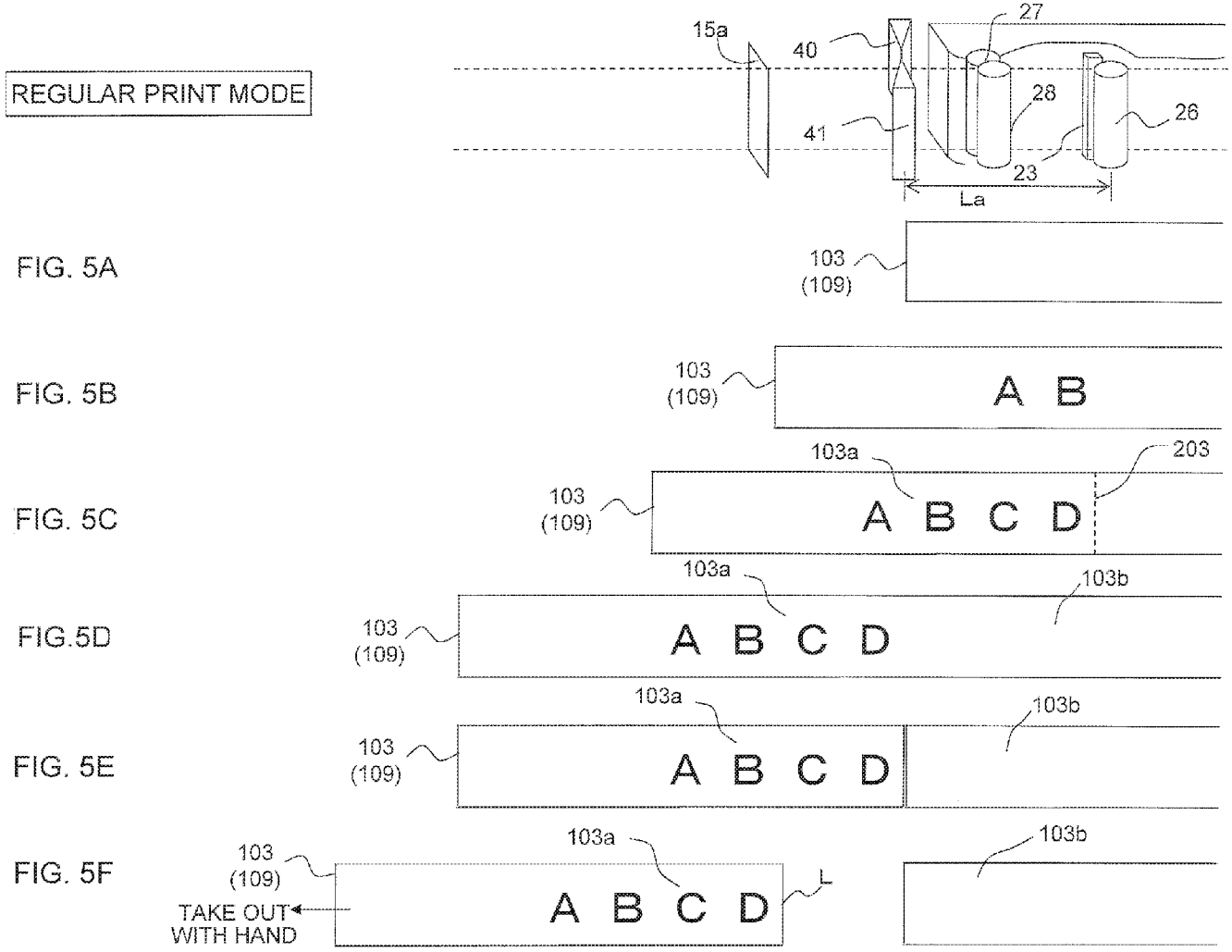
FIG. 5A is an explanatory view for explaining a print label producing operation in a regular print mode.
FIG. 5B is an explanatory view for explaining the print label producing operation in the regular print mode.
FIG. 5C is an explanatory view for explaining the print label producing operation in the regular print mode.
FIG. 5D is an explanatory view for explaining the print label producing operation in the regular print mode.
FIG. 5E is an explanatory view for explaining the print label producing operation in the regular print mode.
FIG. 5F is an explanatory view for explaining the print label producing operation in the regular print mode.

FIG. 5A shows an initial position state (in which the print label L produced earlier has been cut). For example, when an appropriate print start instruction is input in this state, the feeding of the print-receiving tape 103, the base tape 101, and the printed label tape 109 (hereinafter also simply referred to as "tape feeding") is started. Additionally, the printing head 23 is accordingly energized as described above to start print formation of desired contents (alphabet characters "ABCD" in this example) on a first tape portion 103*a* including a predetermined print area on the print-receiving tape 103.

FIG. 5B shows a state in which characters "A" and "B" of the above described "ABCD" are formed as described. When the tape feeding and the print formation further proceed, the print of all the characters "ABCD" is completed (see FIG. 5C). It is noted that FIG. 5C conceptually shows an end part on the transport-direction upstream side of a printed tape portion including the print of the above described "ABCD" and corresponding to the print label L (in other words, a boundary position between a portion corresponding to the print label L and an unprinted tape portion on the upstream side thereof; hereinafter, also simply referred to as a "boundary position") together as a broken line 203.

The energization of the printing head 23 is terminated in the above described print completion state and only the tape feeding is continuously performed.

Subsequently, the feeding is continued until the above described boundary position faces the above described movable blade 41 and, when the boundary position faces the movable blade 41, the tape feeding is stopped and the tape is positioned (see FIG. 5D).

Subsequently, when the cut lever 50 is manually operated by an operator, the movable blade 41 and the fixed blade 40 cooperate with each other to cut the above described boundary position (see FIG. 5E; as described above, actually, the printed label tape 109 including the print-receiving tape 103 and the base tape 101 is cut as a whole). As a result, the first tape portion 103*a*, i.e., the above described printed tape portion having the print "ABCD" formed thereon, is separated from a second tape portion 103*b* that is the above described unprinted tape portion upstream of the above described boundary position on the print-receiving tape 103.

As shown in FIG. 5F, the first tape portion 103*a* separated in this way is discharged to the outside of the housing 2 by holding with a hand and taking out a tip end part projected from the discharging exit 15*a* on the side surface of the lower cover 15.

<Print Label Producing Operation in Continuous Print Mode>

Figures 6A, 6B, 6C, 6D, 6E, 6F, 6G:
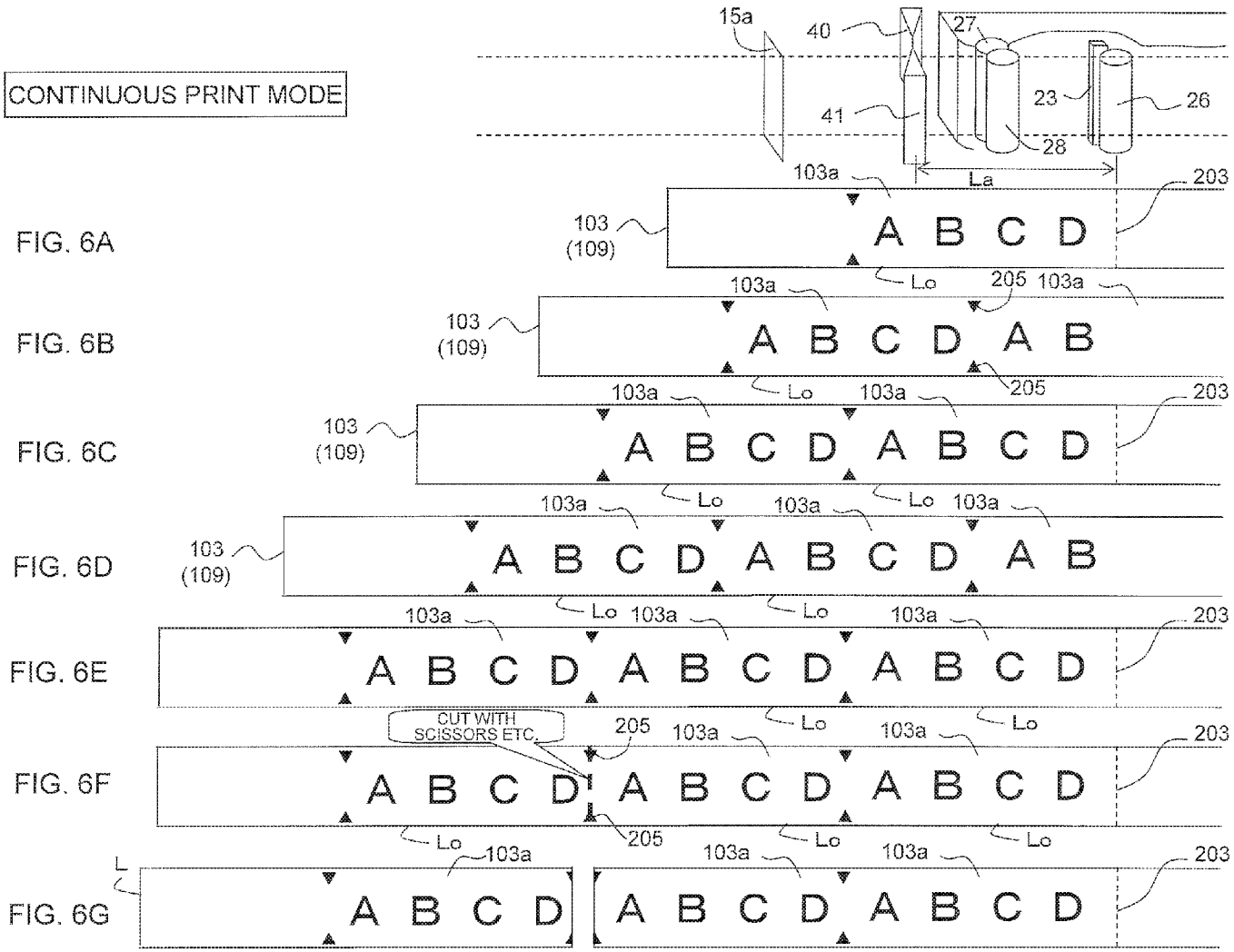
FIG. 6A is an explanatory view for explaining a print label producing operation in a continuous print mode.
FIG. 6B is an explanatory view for explaining the print label producing operation in the continuous print mode.
FIG. 6C is an explanatory view for explaining the print label producing operation in the continuous print mode.
FIG. 6D is an explanatory view for explaining the print label producing operation in the continuous print mode.
FIG. 6E is an explanatory view for explaining the print label producing operation in the continuous print mode.
FIG. 6F is an explanatory view for explaining the print label producing operation in the continuous print mode.
FIG. 6G is an explanatory view for explaining the print label producing operation in the continuous print mode.

A producing operation of a print tape in the above described continuous print mode will be described with reference to FIGS. 6A to 6F. As described above with reference to FIG. 5A to 5C, when a print start instruction is input, the tape feeding is started and the print formation of "ABCD" is started on the first tape portion 103*a* of the print-receiving tape 103. When the print of all the characters of the above described "ABCD" is completed as described above, the energization of the printing head 23 is terminated and, in this continuous print mode, the tape is slightly fed until the above described boundary position (a position at which cut marks 205 described later are formed; indicated by the broken line 203 as is the case with FIG. 5) faces the printing head 23 and is then positioned by stopping the tape feeding. FIG. 6A shows a positioning stop state corresponding to FIG. 5C.

Unlike FIG. 5, the cutting by the movable blade 41 is not performed and the print label part Lo produced as described above is kept connected to the subsequent print-receiving tape 103. When the next print start instruction is input, the tape feeding is started again and the print formation of "ABCD" is started again on the similar first tape portion 103*a* subsequent to the first tape portion 103*a* described above on the print-receiving tape 103 (see FIG. 6B). In the case of the continuous print mode, the adjacent print label parts Lo, Lo are not cut from each other as described above and, therefore, the suitable cut marks 205 (two rectangular shapes facing each other in this example) are printed and formed at the above described boundary position when the above described print formation is started (resumed). In this example, the above described cut marks 205 are also formed at a transport-direction downstream tip end of the leading first tape portion 103*a* (i.e., the start position of the print area). As in the above description, when the print of the above described "ABCD" is completed, the energization of the printing head 23 is terminated, and when the above described boundary position (a scheduled position of formation of the cut marks 205) faces the printing head 23, the tape feeding is stopped (see FIG. 6C).

Subsequently, the same process is repeated each time a print start instruction is input (see FIGS. 6D and 6E). As a result, a plurality of the above described print label parts Lo is produced in a continuously connected form (so-called chain print).

For example, in the state shown in FIG. 6E in which the above described three print label parts Lo are continuously produced in a connected form, if an operator intends to take out the most downstream print label part Lo exposed outside the housing 2 from the discharging exit 15*a*, cutting is performed by using, for example, scissors at the position of the boundary identifiers 205 as shown in FIG. 6F. As a result, as shown in FIG. 6G, the downstream print label part Lo can be separated at the boundary identifiers 205 from the other portion to acquire the print label L.

<Inconvenience that May Occur in Continuous Print Mode>

Description will be made of an inconvenience that may occur when a plurality of the print label parts Lo is produced in a connected state in the continuous print mode as described above.

<First Comparison Example>

Figures 7A, 7B, 7C, 7D, 7E:
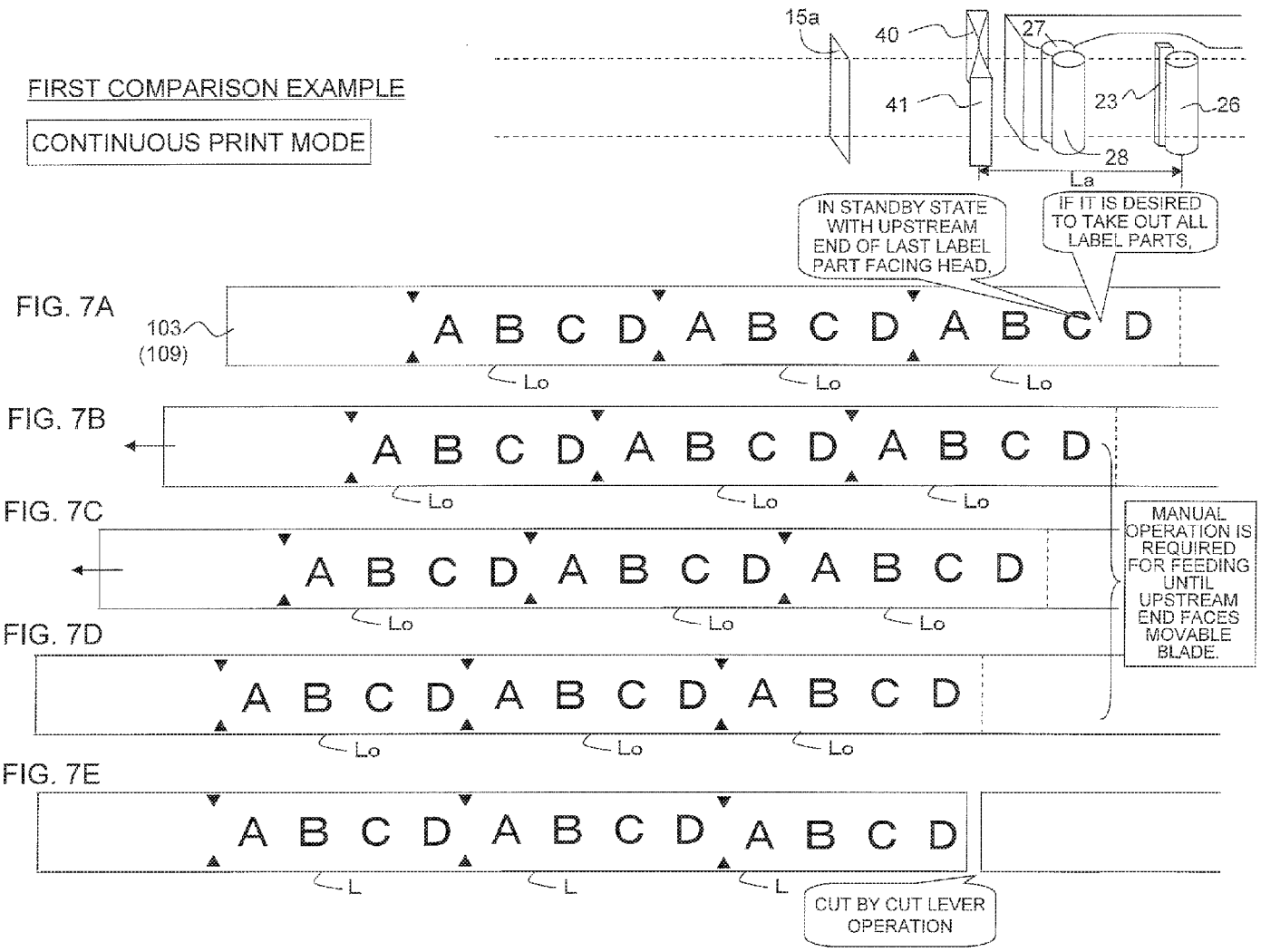
FIG. 7A is an explanatory view of a first comparison example for the embodiment of the present disclosure.
FIG. 7B is an explanatory view of the first comparison example for the embodiment of the present disclosure.
FIG. 7C is an explanatory view of the first comparison example for the embodiment of the present disclosure.
FIG. 7D is an explanatory view of the first comparison example for the embodiment of the present disclosure.
FIG. 7E is an explanatory view of the first comparison example for the embodiment of the present disclosure.

For example, in the state in which the above described three print label parts Lo are continuously produced in a connected form as described above (see FIG. 6E), the printing head 23 is faced by the above described boundary position (the scheduled position of formation of the cut marks 205) positioned at an upstream end part of the print label part Lo produced lastly in order at this point (i.e., positioned most upstream of all the print label parts and shown on the rightmost side). If an operator intends to take out all the three print label parts Lo in this state as shown in FIG. 7A, the operator manually operates a suitable key out of the above described functional keys 4 to perform the above described tape feeding (so-called tape feeding operation; see FIG. 7B→FIG. 7C→FIG. 7D) until the upstream end part of the above described print label part Lo last in order is at a position facing the above described movable blade 41. As a result, the above described three connected print label parts Lo can be separated from the upstream printed label tape 109 by operating the cut lever 50 as described above so as to acquire the three print labels L as shown in FIG. 7E. However, the manual operation for the above described tape feeding is a troublesome operation for the operator and inconveniently increase a labor burden.

<Second Comparison Example>

Figures 8A, 8B, 8C:
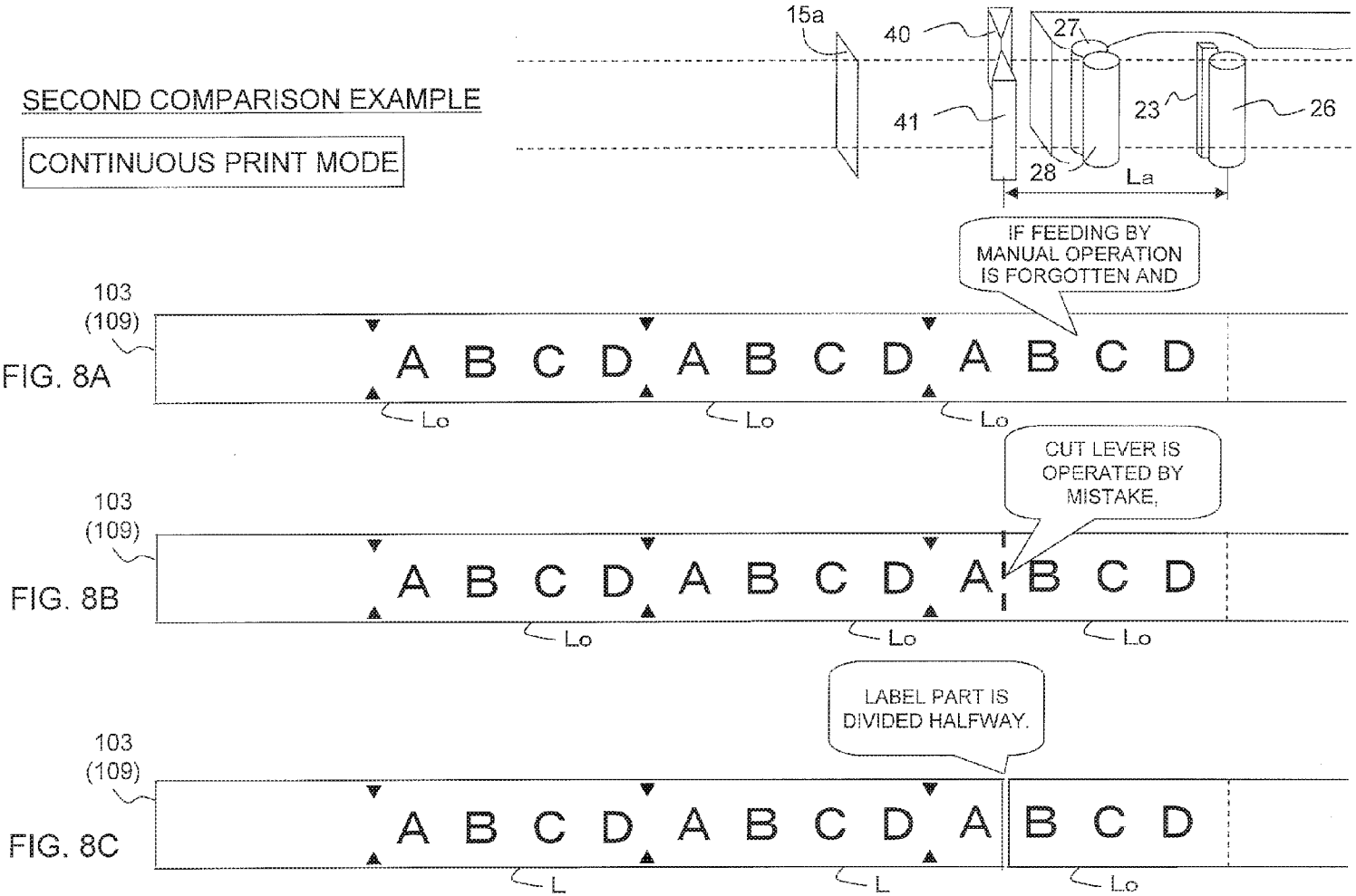
FIG. 8A is an explanatory view of a second comparison example for the embodiment of the present disclosure.
FIG. 8B is an explanatory view of the second comparison example for the embodiment of the present disclosure.
FIG. 8C is an explanatory view of the second comparison example for the embodiment of the present disclosure.

If an operator carelessly forgets the above described manual operation (see FIG. 8A) and operates the cut lever 50 by mistake as shown in FIG. 8B, the above described print label part Lo last in order is divided halfway as shown in FIG. 8C. In the shown example, the above described print label part Lo is inconveniently divided between the characters "A" and "B" so that both the side including the character "A" and the side including the characters "BCD" cannot be used as a print label.

<Print Label Production Technique of this Embodiment>

Figures 9A, 9B, 9C:
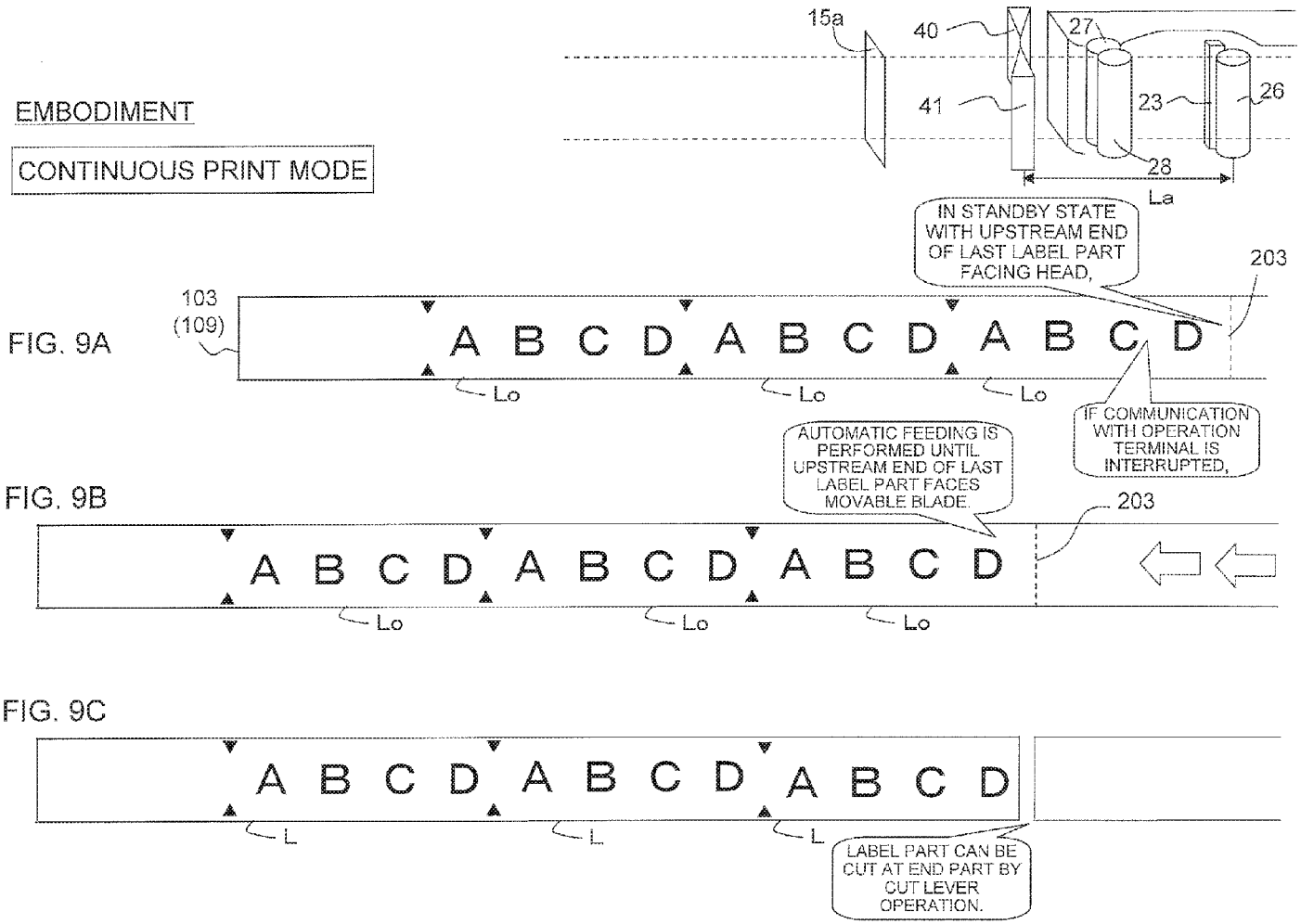
FIGS. 9A-9C are explanatory views for explaining a behavior when communication with the operation terminal is interrupted in the continuous print mode.

To avoid the above described inconveniences, the above described tape feeding is automatically resumed in this embodiment if an established communication with the above described operation terminal 300 is interrupted while the upstream end part (indicated by a broken line in the figures) of the print label part Lo produced lastly in order (shown on the rightmost side) faces the printing head 23 (see FIG. 9A).

When the upstream end part of the above described print label part Lo faces the movable blade 41, the tape is positioned by stopping the feeding (FIG. 9B) and enters a standby state. As a result, as in the above description, the operator can operate the cut lever 50 to separate the above described three connected print label parts Lo from the printed label tape 109 on the upstream side, so as to acquire the three print labels L (see FIG. 9C).

<Details of Control Carried Out by CPU>

Figure 10:
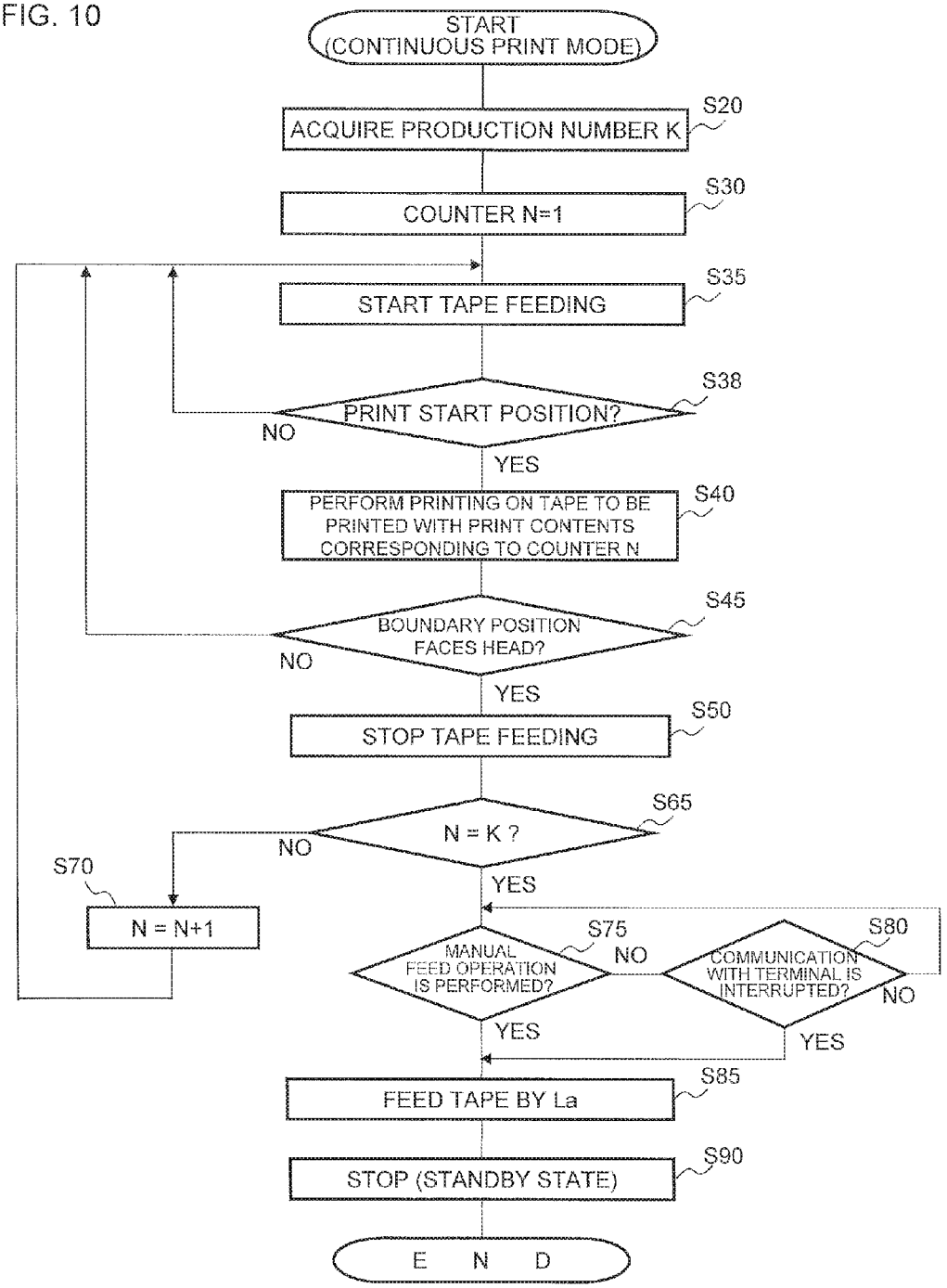
FIG. 10 is a flowchart of a control procedure executed by a CPU of a control circuit in the continuous print mode.
Figure 11:
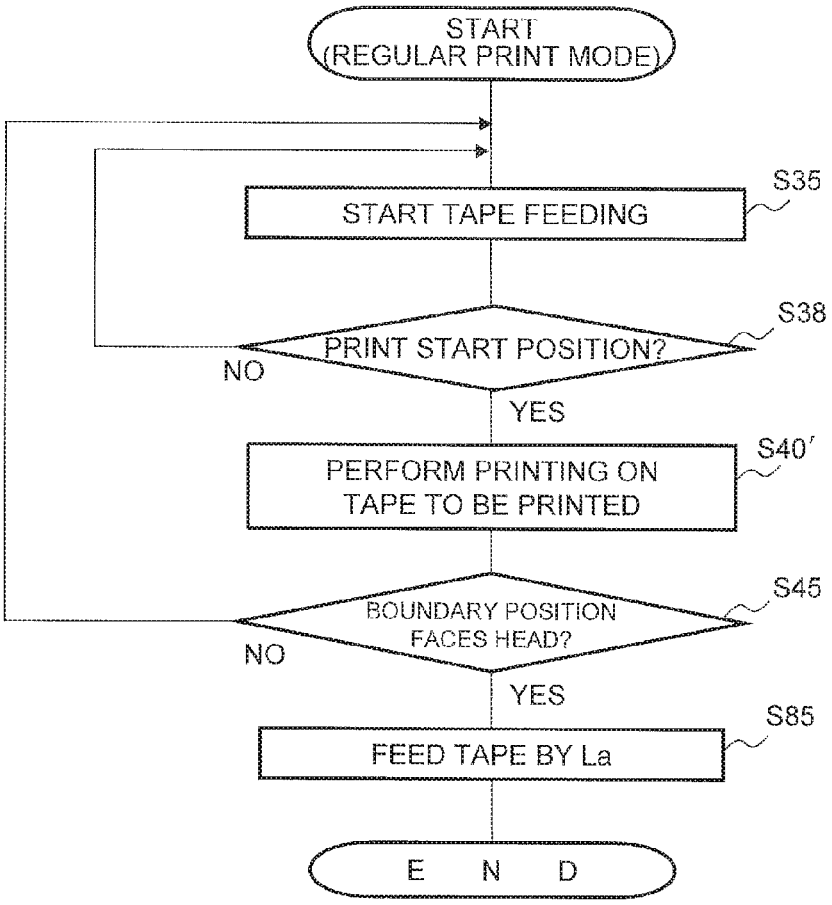
FIG. 11 is a flowchart of a control procedure executed by the CPU of the control circuit in the regular print mode.

As described above, either the above described continuous print mode or the above described regular print mode is selectively performed by the CPU in the tape printer 1 of this embodiment (i.e., either a flow of FIG. 10 or a flow of FIG. 11 is selectively performed).

<Continuous Print Mode>

A control procedure will be described that is performed by a CPU (not particularly shown) of the control circuit 140 of the tape printer 1 so as to implement the above described technique of this embodiment in the above described continuous print mode, with reference to the flow of FIG. 10. It is noted that before this flow is performed, the production number K and the respective print contents of the print labels L are input and set in advance by an operator by using the operation part 302 of the above described operation terminal 300. The communication with the operation terminal 300 is then established via the above described communication control part 142 and the above described communication control part 306 and, when a print start instruction including the above described production number K and the above described print contents is received from the operation terminal 300, this flow is started.

First, at step S20, the above described CPU acquires the production number K of the above described print label L included in the print start instruction transmitted from the above described operation terminal 300.

At step S30, the above described CPU initializes a counter variable N corresponding to the number of print processes to the print-receiving tape 103 (in other words, the number of the above described produced print label parts Lo) to one.

Subsequently, going to step S35, the above described CPU starts the above described tape feeding. Specifically, the CPU outputs an instruction signal instructing the above described feeding roller driving circuit 35 to start driving so as to rotate the feeding roller driving shaft 108 via the feeding roller motor 34, thereby starting the feeding of the above described print-receiving tape 103, the base tape 101, and the printed label tape 109.

At step S38, the above described CPU determines whether the tapes started being fed as described above arrive at a print start position of the print-receiving tape 103. Specifically, the CPU determines with a known technique whether the downstream tip end part of the print area described above faces the position facing the printing head 23. If not arriving at the print start position, the determination is negative (S38:NO) and the CPU returns to step S35 to feed the print-receiving tape 103 to the print start position. If arriving at the print start position, the determination is affirmative (S38:YES) and the CPU goes to step S40.

At step S40, the above described CPU controls the printing head 23 via the print-head driving circuit 31 to form on the print-receiving tape 103 the print contents corresponding to the current value of the counter variable N out of the above described print contents included in the print start instruction transmitted from the above described operation terminal 300.

Subsequently, at step S45, the above described CPU further performs the tape feeding after completion of the print formation process of above described step S40 and determines whether the printing head 23 is faced by the above described boundary position corresponding to the upstream end part of the above described print label part Lo on the print-receiving tape 103. If the printing head 23 is not faced by the above described boundary position, the determination is negative (S45:NO) and the CPU returns to step S35 to repeat the same procedure. On the other hand, if the printing head 23 is faced by the above described boundary position, the determination is affirmative (S45:YES) and the CPU goes to step S50.

At step S50, the above described CPU stops the above described tape feeding. Specifically, the CPU outputs an instruction signal instructing the feeding roller driving circuit 35 to stop driving so as to stop the feeding roller driving shaft 108 rotated by the feeding roller motor 34.

Subsequently, going to step S65, the above described CPU determines whether the current value of the above described counter variable N becomes equal to the production number K. In other words, the CPU determines whether the production of the above described print label parts Lo is completed by the production number K. If the value of the counter variable N is different from the production number K, the determination is negative (S65:NO) and the CPU adds one to the value of the counter variable N at step S70 before returning to step S35 to repeat the above described same procedure. When this procedure is repeated, the CPU also performs the print formation of the above described boundary identifier 205 at the boundary position at step S40 after steps S35 and S38.

On the other hand, if the value of the counter variable N becomes equal to the production number K at step S65, the determination is affirmative (S65:YES) and the CPU goes to step S75. At step S75, the above described CPU determines whether a feed process is executed through a manual operation of a suitable key of the functional keys 4. If the feed process is executed, the determination is affirmative (S75:YES) and the CPU goes to step S85 described later. If the feed process is not executed, the determination is negative (S75:NO) and the CPU goes to step S80.

At step S80, the above described CPU determines whether the communication with the operation terminal 300 is interrupted that has been established via the above described communication control part 142 and the above described communication control part 306 as described above. Examples of the interruption include when the operation terminal 300 goes out of a wireless communication area, when the operation terminal 300 is powered off, and when a LAN cable for wired connection to the operation terminal is pulled out of the tape printer 1 (or the operation terminal 300). If the communication is not interrupted, the determination is negative (S80:NO) and the CPU returns to step S75 to return the same procedure. If the communication is interrupted, the determination is affirmative (S80:YES) and the CPU returns to step S85.

At step S85, the above described CPU outputs an instruction signal instructing the above described feeding roller driving circuit 35 to perform driving so as to start the feeding roller motor 34 to rotate the feeding roller driving shaft 108, thereby performing the above described tape feeding by the distance La described above (corresponding to the separation distance between the printing head 23 and the movable blade 41).

Subsequently, at step S90, the above described CPU outputs an instruction signal instructing the feeding roller driving circuit 35 to stop driving so as to stop the feeding roller driving shaft 108 rotated by the feeding roller motor 34 and terminate the above described tape feeding, thereby achieving the standby state of waiting for cutting by the movable blade 41. Subsequently, the CPU terminates this flow.

<Regular Print Mode>

A control procedure performed by the CPU of the control circuit 140 in the above described regular print mode is shown in FIG. 11. As in the above description, this flow is started when a print start instruction including the print contents is received from the operation terminal 300.

As shown in FIG. 11, in this regular print mode, the above described CPU starts tape feeding as described above at step S35 same as FIG. 10. Subsequently, at step S38 same as FIG. 10, the above described CPU determines whether the tapes arrive at the print start position of the print-receiving tape 103. If not arriving at the print start position, the determination is negative (S38:NO) and the CPU returns to step S35 to perform the tape feeding to the print start position. If arriving at the print start position, the determination is affirmative (S38:YES), and the CPU goes to step S40' corresponding to above described step S40.

At step S40', as is the case with above described step S40, the above described CPU controls the printing head 23 via the print-head driving circuit 31 to form on the print-receiving tape 103 the print contents included in the print start instruction transmitted from the above described operation terminal 300.

Subsequently, at step S45 same as FIG. 10, the above described CPU further performs the tape feeding after completion of the print formation process of above described step S40' and determines whether the printing head 23 is faced by the above described boundary position. If the printing head 23 is not faced by the above described boundary position, the determination is negative (S45:NO) and the CPU returns to step S35 to repeat the same procedure. If the printing head 23 is faced by the boundary position, the determination is affirmative (S45:YES) and the CPU goes to step S85 same as FIG. 10.

At step S85, the above described CPU performs the tape feeding by the distance La as described above and terminates this flow.

<Effects of this Embodiment>

As described above, when the upstream end part of the print label part Lo last in order faces the printing head 23 in the case of operation in the continuous print mode in this embodiment, the feeding triggered by interruption of communication with the operation terminal 300 is automatically performed by the above described distance La, and the above described upstream end part faces the movable blade 41 in the standby state. As a result, since the separate tape feeding operation by the operator is no longer required as described above, the operator's labor burden can be reduced and the inconvenience such as dividing a print tape halfway as described above can be prevented.

The present disclosure is not limited to the above described embodiment and may variously be modified without departing from the spirit and the technical ideas thereof. For example, after the automatic feeding following the communication interruption state described above, the movable blade 41 operates in accordance with the operation of the cut lever 50 by the operator (transmitted through a suitable mechanical mechanism to the movable blade 41) in the example described above; however, this is not a limitation. In particular, after the above described automatic feeding, a solenoid disposed for driving the movable blade 41 may be automatically energized so that the movable blade 41 automatically operates to perform the cutting. Alternatively, the solenoid may be energized by the operator operating a suitable button or switch so that the movable blade 41 operates to perform the cutting. These cases provide the same effects as described above.

In the above description, the operation terminal 300 is connected through a wired or wireless communication line to the tape printer 1, and the print label L is produced by receiving a print start instruction including print data representative of the above described production number K and the print contents from the operation terminal 300. However, the present disclosure is not limited thereto. In particular, the above described technique of the present disclosure may be applied to the tape printer 1 of a so-called stand-alone type using the print data representative of the above described production number K and the above described print contents generated based on operator's operational input to the above described keyboard 3 and the functional keys 4. In this case, in a procedure corresponding to step S80 of FIG. 10, the CPU of the above described control circuit 140 may determine that the above described environmental change condition is satisfied when the tape printer 1 itself is powered off or when predetermined settings (e.g., various settings of print operation) are changed in the tape printer 1, and may go to the process of above described step S85.

The arrows shown in FIG. 4 indicate an example of signal flow and are not intended to limit the signal flow directions. The flowcharts shown in FIGS. 10 and 11 are not intended to limit the present disclosure to the procedures shown in the above described flows and the procedures may be added/deleted or may be executed in different order without departing from the spirit and the technical ideas of the disclosure.

The techniques of the above described embodiment and the modification examples may appropriately be utilized in combination other than those described above.

What is claimed is:

1. A printer comprising:

a feeder configured to feed a print-receiving tape;

a printing head that is configured to perform print on said print-receiving tape and is disposed on a feeding path of said feeder;

a cutter that is configured to cut said print-receiving tape in a thickness direction and is disposed downstream of said printing head along said feeding path; and a controller, said controller being configured to control said feeder and said printing head in coordination with each other to selectively perform either a regular print mode or a continuous print mode, said regular print mode including performing a print formation process for forming a desired print while feeding said print-receiving tape and a first cut-feeding process for further feeding said print-receiving tape after completion of said print formation process such that said print-receiving tape is positioned by stopping the feeding when a boundary position of said print-receiving tape faces said cutter wherein the boundary position is defined as a boundary between a printed tape portion having said desired print formed thereon and an unprinted tape portion, said continuous print mode including performing said print formation process and a continuous print feeding process for further feeding said print-receiving tape after completion of said print formation process such that the feeding of said print-receiving tape is stopped with said boundary position of said print-receiving tape facing said printing head, said controller being configured to:

execute a determination process for determining whether a predetermined environmental change condition is satisfied while said continuous print mode is selected; and control said feeder to execute a second cut-feeding process, in the case that it is determined in said determination process that said environmental change condition is satisfied, for resuming the feeding of said print-receiving tape stopped with said boundary position located facing said printing head by said continuous print feeding process such that said print-receiving tape is positioned by stopping the feeding when said boundary position faces said cutter.

2. The printer according to claim 1, wherein said controller is configured to control said feeder and said printing head in coordination with each other in said continuous print feeding process in said continuous print mode to further feed said print-receiving tape after completion of said print formation process such that the feeding of said print-receiving tape is stopped with said boundary position of said print-receiving tape facing said printing head, and said controller is configured to control said feeder in said second cut-feeding process to resume the feeding after print formation of a predetermined boundary identifier on said print-receiving tape stopped at the located position facing the said printing head by said continuous print feeding process such that said print-receiving tape is positioned by stopping the feeding when said boundary identifier faces said cutter.

3. The printer according to claim 1, further comprising a communication device configured to perform mutual recognition communication including connection authentication with an operation terminal, wherein said controller is configured to:

determine whether said mutual recognition communication with said operation terminal is interrupted as said environmental change condition in said determination process; and control said feeder to execute said second cut-feeding process in the case that it is determined in said determination process that said mutual recognition communication is interrupted.

4. The printer according to claim 1, wherein said controller is configured to:

determine whether said printer is powered off or whether predetermined settings are changed in said printer as said environmental change condition in said determination process; and control said feeder to execute said second cut-feeding process in the case that it is determined in said determination process that said printer is powered off or that said predetermined settings are changed.

5. The printer according to claim 1, further comprising a solenoid configured to be capable of moving said cutter;

a solenoid driving circuit configured to drive said solenoid; and a cut key, wherein said controller is configured to execute said print formation process, said first cut-feeding process, and a first cutting standby process for waiting for a depression signal of said cut key after positioning of said first cut-feeding process in said regular print mode, and said controller is configured to control said feeder to execute said second cut-feeding process and a second cutting standby process for waiting for a depression signal of said cut key after positioning of said second cut-feeding process, in the case that it is determined in said determination process that said environmental change condition is satisfied.

6. The printer according to claim 5, wherein said controller is configured to:

control said feeder and said printing head in coordination with each other in said continuous print feeding process in said continuous print mode to further feed said print-receiving tape after completion of said print formation process such that the feeding of said print-receiving tape is stopped with said boundary position of said print-receiving tape facing said printing head;

control said feeder to resume the feeding after print formation of a predetermined boundary identifier on said print-receiving tape stopped at the located position facing the said printing head by said continuous print feeding process such that said print-receiving tape is positioned by stopping the feeding when said boundary identifier faces said cutter in said second cut-feeding process; and control said feeder to wait for a depression signal of said cut key after positioning of said second cut-feeding process in said second cutting standby process.

7. The printer according to claim 5, wherein said controller is configured to:

control said feeder to resume the feeding after print formation of a predetermined boundary identifier on said print-receiving tape stopped at the located position facing the said printing head by said continuous print feeding process such that said print-receiving tape is positioned by stopping the feeding when said boundary identifier faces said cutter in said second cut-feeding process; and control said feeder to automatically energize said solenoid driving circuit after positioning of said second cut-feeding process such that said solenoid is driven to operate said cutter so as to cut said printed tape in said second cutting standby process.

* * * * *